United States Patent [19]

Dustmann

[11] Patent Number: 4,578,962

[45] Date of Patent: Apr. 1, 1986

[54] COOLING SYSTEM FOR INDIRECTLY COOLED SUPERCONDUCTING MAGNETS

[75] Inventor: Cord-Henrich Dustmann, Weinheim, Fed. Rep. of Germany

[73] Assignee: Brown, Boveri & Cie Aktiengesellschaft, Mannheim-Kaefertal, Fed. Rep. of Germany

[21] Appl. No.: 678,705

[22] Filed: Dec. 6, 1984

[30] Foreign Application Priority Data

Dec. 6, 1983 [DE] Fed. Rep. of Germany ..... 3344046

[51] Int. Cl.[4] ..... F25B 31/00

[52] U.S. Cl. ..... 62/505; 62/54; 62/514 R; 62/515; 310/54; 310/61; 310/64

[58] Field of Search ..... 62/54, 505, 514 R, 515; 310/54, 61, 64

[56] References Cited

U.S. PATENT DOCUMENTS

| | | | |
|---|---|---|---|
| 2,897,382 | 7/1959 | Hamill | 310/54 |
| 3,074,401 | 1/1963 | Friedman et al. | 62/515 |
| 3,122,668 | 2/1964 | Cuny | 310/64 |
| 3,238,400 | 3/1966 | Wireman | 310/54 |
| 3,241,329 | 3/1966 | Fritch, Jr. et al. | 62/514 R |
| 3,363,207 | 1/1968 | Brechna | 62/514 R |
| 4,209,657 | 6/1980 | Inai et al. | 62/514 R |
| 4,277,949 | 7/1981 | Longsworth | 62/54 |
| 4,427,907 | 1/1984 | Flick et al. | 310/54 |

FOREIGN PATENT DOCUMENTS 2206841 9/1972 Fed. Rep. of Germany .

*Primary Examiner*—Ronald C. Capossela

*Attorney, Agent, or Firm*—Herbert L. Lerner; Laurence A. Greenberg

[57] ABSTRACT

A cooling system for indirectly cooled superconducting magnets of a superconducting winding, includes a winding form having canals formed therein through which liquid helium flows, the canals including a lower feed canal, an upper collecting canal and mutually parallel cooling canals interconnecting the feed and collecting canals in close thermal contact with the superconducting winding, a helium supply vessel disposed opposite to and elevated with respect to the winding form, the helium supply vessel having an outlet and a connecting stub, an outgoing line connected between the feed canal and the outlet, and a return line connected between the collecting canal and the connecting stub.

5 Claims, 2 Drawing Figures

COOLING SYSTEM FOR INDIRECTLY COOLED SUPERCONDUCTING MAGNETS

Figure 1:
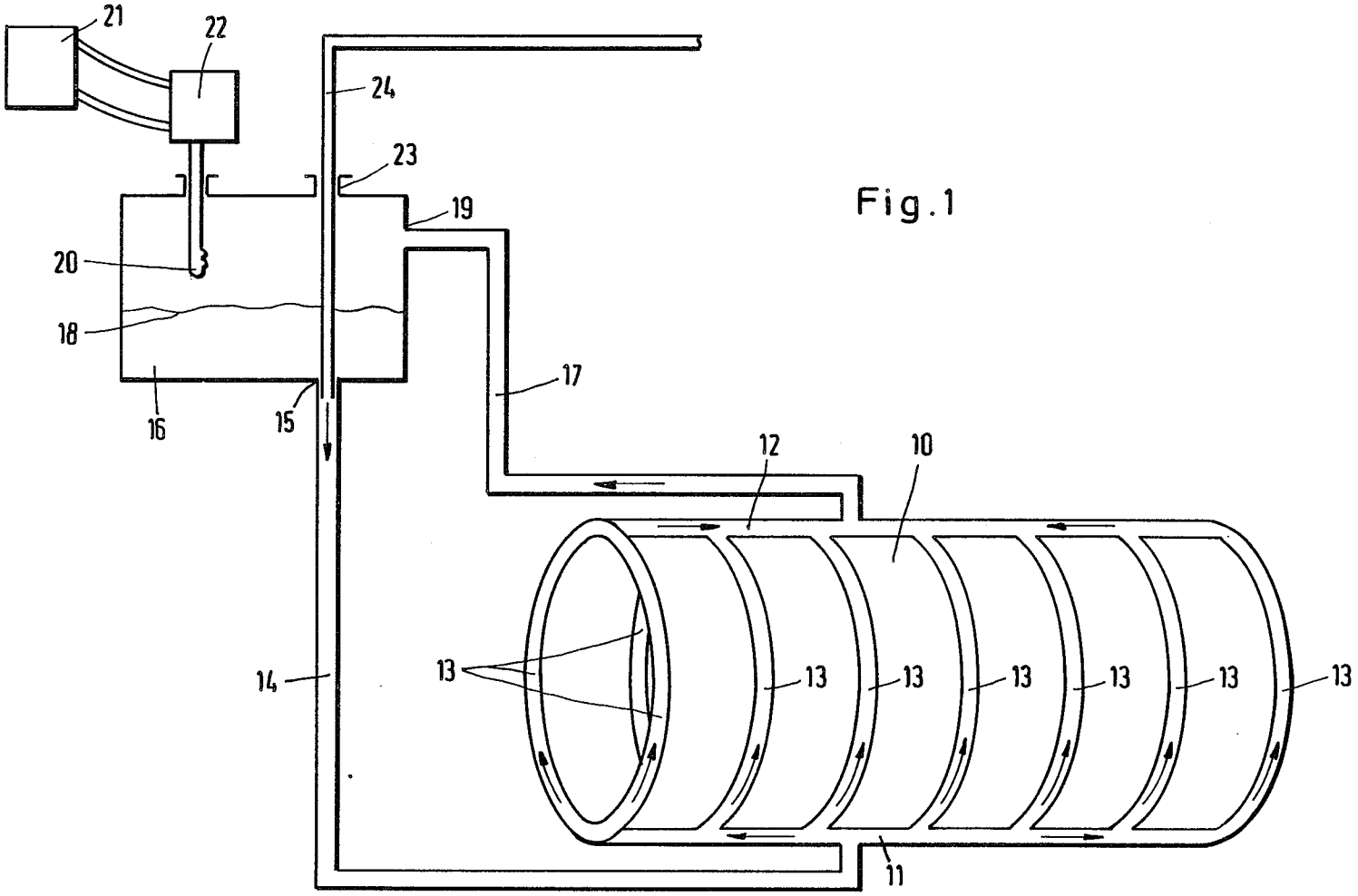

The invention relates to a cooling system for indirectly cooled superconducting magnets with cooling canals through which liquid helium flows, the cooling canals being in close thermal contact with the superconducting winding.

Indirectly cooled magnets have cooling coils through which liquid helium is pushed. This presents no problems if supercritical helium is used. However, a pump is required which pushes the liquid helium through the cooling coils. If the cooling coils are connected to a refrigeration plant, the pump can be part of the refrigeration plant. However, if the helium is taken from a supply vessel, a separate pump for helium is required.

If the use of a helium pump is to be avoided and/or if two-phase helium is to be used for cooling, there is a danger of instabilities occuring due to the so-called garden-hose effect, if the cooling canals are disposed in vertical coils, as is frequently the case with magnets having a horizontal magnetic field axis. The garden-hose effect prevents cooling with two-phase helium with circular cooling canals, if a helium supply vessel and a mini-refrigerator is used which requires no expansion machine.

It is accordingly an object of the invention to provide a cooling system for indirectly cooled superconducting magnets, which overcomes the hereinafore-mentioned disadvantages of the heretoforeknown devices of this general type, and which permits convection cooling.

With the foregoing and other objects in view there is provided, in accordance with the invention, a cooling system for indirectly cooled superconducting magnets of a superconducting winding, comprising a winding form having canals formed therein through which liquid helium flows, the canals including a lower feed canal, an upper collecting canal and mutually parallel cooling canals interconnecting the feed and collecting canals in close thermal contact with the superconducting winding, a helium supply vessel disposed opposite to and elevated with respect to the winding form, the helium supply vessel having an outlet and a connecting stub, an outgoing line connected between the feed canal and the outlet, and a return line connected between the collecting canal and the connecting stub.

The liquid helium can flow through the outlet of the helium vessel into the lower feed canal and can rise from there in a parallel manner through the cooling canals into the upper collecting canal. The helium which has in the meantime been warmed up and can be present in the vapor phase, is conducted from the collecting canal into the return line, which returns the helium above the helium level into the helium supply vessel. No pump is required for circulating the helium; the circulation is due to convection.

In accordance with another feature of the invention, the winding form is rolled-seam welded and the cooling canals are blown into shape. In this case, care is taken to ensure that the curvature of the inflated cooling canals is toward the side facing away from the winding. This allows cost-effective fabrication while preserving high quality.

In accordance with a further feature of the invention, the winding form is a quenching bar for quenching safety, the winding form is formed of high purity aluminum, and the cooling canals are integral therewith. The winding form can also be made of austenitic steel. Aluminum increases the quenching safety according to the "quench bare" principle.

In accordance with an added feature of the invention, there is provided a refrigeration device or mini-refrigerator having a cold head with an end extended into the helium supply vessel. The mini-refrigerator works, for instance, in accordance with the Gifford-McMahon principle. The temperature of the cold head end is at about 4.2 K or below. The end of the cold head extends into the gas space of the helium supply vessel and recondenses the helium gas flowing back through the return line.

In accordance with a concomitant feature of the invention, the outlet is disposed at the bottom of the helium supply vessel, and the helium supply vessel includes a connecting flange disposed above the outlet, and including a helium siphon partially inserted into the outgoing line through the connecting flange.

The use of a mini-refrigerator is usually unsuited for the initial cooling of the winding form. For this purpose, the invention provides that the helium supply vessel has the connecting flange for the helium siphon, which can be disposed above the discharge. In order to fill up the system with liquid helium, the helium siphon is pushed through the connecting flange so far that it partially protrudes into the outgoing line and is screwed in. The other end of the helium siphon extends into a helium can. Enough helium is conducted from the helium can into the helium supply vessel and the winding form so that the vessel is cooled down and is filled up to a given height. The helium supply vessel also contains a closeable opening through which the still warm, gaseous helium can escape.

Other features which are considered as characteristic for the invention are set forth in the appended claims.

Although the invention is illustrated and described herein as embodied in a cooling system for indirectly cooled superconducting magnets, it is nevertheless not intended to be limited to the details shown, since various modifications and structural changes may be made therein without departing from the spirit of the invention and within the scope and range of equivalents of the claims.

Figure 2:
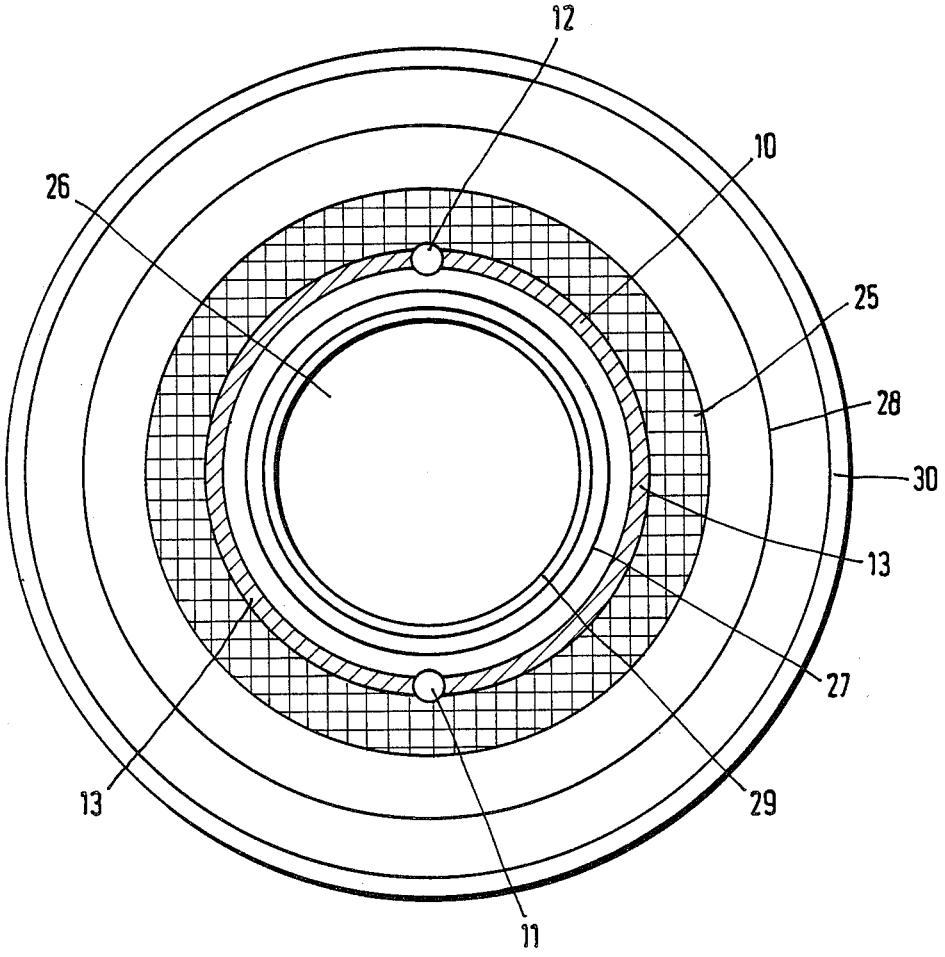

The construction and method of operation of the invention, however, together with additional objects and advantages thereof will be best understood from the following description of specific embodiments when read in connection with the accompanying drawings, in which:

FIG. 1 is a diagrammatic and partly perspective view of the cooling system according to the invention; and FIG. 2 is a cross-sectional view of a superconducting coil located in a cryostat.

Referring now to the figures of the drawings in detail and first particularly to FIG. 1 thereof, there is seen a cylindrical winding body or coil form 10, having a cylindrical surface in which cooling canals are embedded. A feed canal 11 extends axially in the lower portion of the winding body or form 10 and a collecting canal 12 extends axially in the upper portion of the winding body 10. The feed canal 11 and the collecting canal 12 are interconnected by several cooling canals 13 which are mutually parallel and are embedded in the inner surface of the winding body 10.

Such a winding body or form 10 can be fabricated by rolled-seam welding and subsequent inflation of the cooling canals.

The lower feed canal 11 is connected through an outgoing line 14 to a bottom outlet 15 of a helium supply vessel 16. Through these lines, liquid helium can be conducted from the helium supply vessel 16 into the cooling canals 13. The heated helium (in the liquid or gaseous phase) is collected by the upper collecting canal 12 and passes through a return line 17 leading to a return inlet 19 at the upper region of the helium supply vessel 16. The helium level 18 in the supply vessel 16 is below the connecting stub or return inlet 19. The end 20 of the cold head 22, which is connected to a compressor 21 of a mini-refrigerator, extends into the gas space of the helium supply vessel 16. The end 20 of the cold head 22 has a sufficiently low temperature to recondense the gaseous helium.

The helium supply vessel 16 also has a connecting flange 23 through which a helium siphon 24 is inserted. The connecting flange 23 is above the bottom outlet 15. The helium siphon 24 is inserted into the flow line 14 and is screwed down for an initial filling of the system.

FIG. 2 illustrates a cross section of a magnet winding 25 with a cooling and vacuum system. The magnet winding 25 is disposed concentrically around an examination opening 26 and is formed of a superconducting wire. The superconducting winding 25 is placed on the winding body or form 10 which is constructed in accordance with FIG. 1. In FIG. 2, the feed canal 11, the collecting canal 12 as well as two cooling canals 13 can be seen. Although not shown in FIG. 1, in FIG. 2 the magnet winding 25 and the winding body or coil form 10 are shielded all around by cold shields 27, 28, and the entire system is mounted in a vacuum container formed of an inner jacket 29 and an outer jacket 30.

The foregoing is a description corresponding in substance to German Application No. P 33 44 046.8-33, filed Dec. 6, 1983, the International priority of which is being claimed for the instant application and which is hereby made part of this application. Any material discrepancies between the foregoing specification and the aforementioned corresponding German application are to be resolved in favor of the latter.

I claim:

1. Cooling system for indirectly cooled superconducting magnets of a superconducting winding, comprising a winding form having canals formed therein through which liquid helium flows by natural connection, said canals including a lower feed canal, an upper collecting canal and mutually parallel cooling canals interconnecting said feed and collecting canals in close thermal contact with the superconducting winding, a helium supply vessel disposed opposite to and elevated with respect to said winding form, said helium supply vessel having an outlet and a connecting stub, an outgoing line connected between said feed canal and said outlet, and a return line connected between said collecting canal and said connecting stub.

2. Cooling system according to claim 1, wherein said winding form is rolled-seam welded and said cooling canals are blown into shape.

3. Cooling system according to claim 1, including a refrigeration device having a cold head with an end extended into said helium supply vessel.

4. Cooling system according to claim 1, wherein said outlet is disposed at the bottom of said helium supply vessel, and said helium supply vessel includes a connecting flange disposed above said outlet, and including a helium siphon partially inserted into said outgoing line through said connecting flange.

5. Cooling system according to claim 1, wherein said winding form is a quenching bar for quenching safety, said winding form is formed of high purity aluminum, and said cooling canals are integral therewith.

* * * * *